US009920978B1

(12) United States Patent
Lee

(10) Patent No.: US 9,920,978 B1
(45) Date of Patent: Mar. 20, 2018

(54) DISPENSER FOR A REFRIGERATOR

(71) Applicant: Dongbu Daewoo Electronics Corporation, Seoul (KR)

(72) Inventor: Wang Goo Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 15/485,151

(22) Filed: Apr. 11, 2017

(30) Foreign Application Priority Data

Sep. 19, 2016 (KR) ..... 10-2016-0119202

(51) Int. Cl.

| | |
|---|---|
| ***B65B 1/04*** | (2006.01) |
| ***F25D 23/12*** | (2006.01) |
| ***F25D 11/02*** | (2006.01) |
| ***F25D 23/02*** | (2006.01) |
| ***B67D 1/00*** | (2006.01) |

(52) U.S. Cl.
CPC ..... *F25D 23/126* (2013.01); *B67D 1/0013* (2013.01); *F25D 11/02* (2013.01); *F25D 23/028* (2013.01); *B67D 2210/00036* (2013.01)

(58) Field of Classification Search
CPC ..... F25D 23/126; F25D 11/02; F25D 23/028; B67D 1/0013; B67D 2210/00036
USPC ..... 141/359, 360
See application file for complete search history.

(56) References Cited

U.S. PATENT DOCUMENTS 3,347,325 A * 10/1967 Espenschied ..... A61C 17/0205 141/359

* cited by examiner

*Primary Examiner* — Jason K Niesz

(57) ABSTRACT

Embodiments of the present disclosure provide a liquid dispenser for a refrigerator. According to some embodiments, the liquid dispenser includes a liquid discharge unit including a nozzle through which liquid received in the liquid dispenser is discharged, and a lever that opens and closes the nozzle based on whether the lever is pressed or not. A liquid receiving unit receives the liquid discharged from the liquid discharge unit, and a support unit allows the liquid receiving unit to be positioned to press the lever based on the weight of liquid in the liquid receiving unit. A damper may be used to stably seat the receiving unit and reduce or eliminate noise generated when liquid flows to the liquid receiving unit.

19 Claims, 5 Drawing Sheets

DISPENSER FOR A REFRIGERATOR

CROSS-REFERENCE TO RELATED APPLICATIONS

This application claims benefit and priority to Korean Patent Application No. 10-2016-0119202, filed on Sep. 19, 2016, with the Korean Intellectual Property Office, the disclosure of which is incorporated herein in its entirety by reference.

TECHNICAL FIELD

The present disclosure relates to a refrigerator, and more specifically, to a device for dispensing liquid from a refrigerator.

BACKGROUND

Many currently available refrigerators include water dispensers located on an outer surface of the refrigerator door.

Including a dispenser on an outer surface of the refrigerator door tends to greatly restrict the exterior design of the refrigerator, and the refrigerator may require more space to accommodate the dispenser. Furthermore, when the door includes glass surfaces, it is difficult to form a hole at the center of the door for installing the dispenser, and the manufacturing costs thereof are increased significantly.

Refrigerators that include dispensers on an outer surface of the refrigerator door are also unable to supply a large amount of cold water on-demand, and various types of sensors are required for dispensing water, thereby increasing the overall price of the product and potentially compromising durability.

SUMMARY

The present disclosure provides a liquid dispenser for a door of a refrigerator. According to some embodiments, the dispenser has a simplified structure to reduce manufacturing costs.

According to one embodiment, a liquid dispenser for a refrigerator is described. The liquid dispenser includes a liquid discharge unit having a nozzle for discharging liquid, and a lever configured to selectively open and close the nozzle, where the nozzle becomes open when the lever is pressed. The liquid dispenser further includes a liquid receiving unit that receives liquid discharged from the liquid discharge unit, and a support unit. The liquid receiving unit is disposed on a top surface of the support unit, and the liquid receiving unit is configured to press the lever when a weight of liquid stored in the liquid receiving unit is below a threshold. The liquid receiving unit is further configured to release the lever when the liquid receiving unit is moved away from the lever due to the weight of liquid stored in the liquid receiving unit being above the threshold.

According to another embodiment, a refrigerator is disclosed. The refrigerator includes a refrigeration compartment, a freezer compartment, and a door configured to selectively open and close the refrigeration compartment and the freezer compartment. The door includes a liquid discharge unit which includes a nozzle for discharging liquid, a lever configured to selectively open and close the nozzle, where the nozzle becomes open when the lever is pressed, and a liquid receiving unit that receives liquid discharged from the liquid discharge unit. The liquid receiving unit is configured to press the lever when a weight of liquid stored in the liquid receiving unit is below a threshold, and configured to release said lever when the weight of liquid stored in the liquid receiving is above said threshold.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
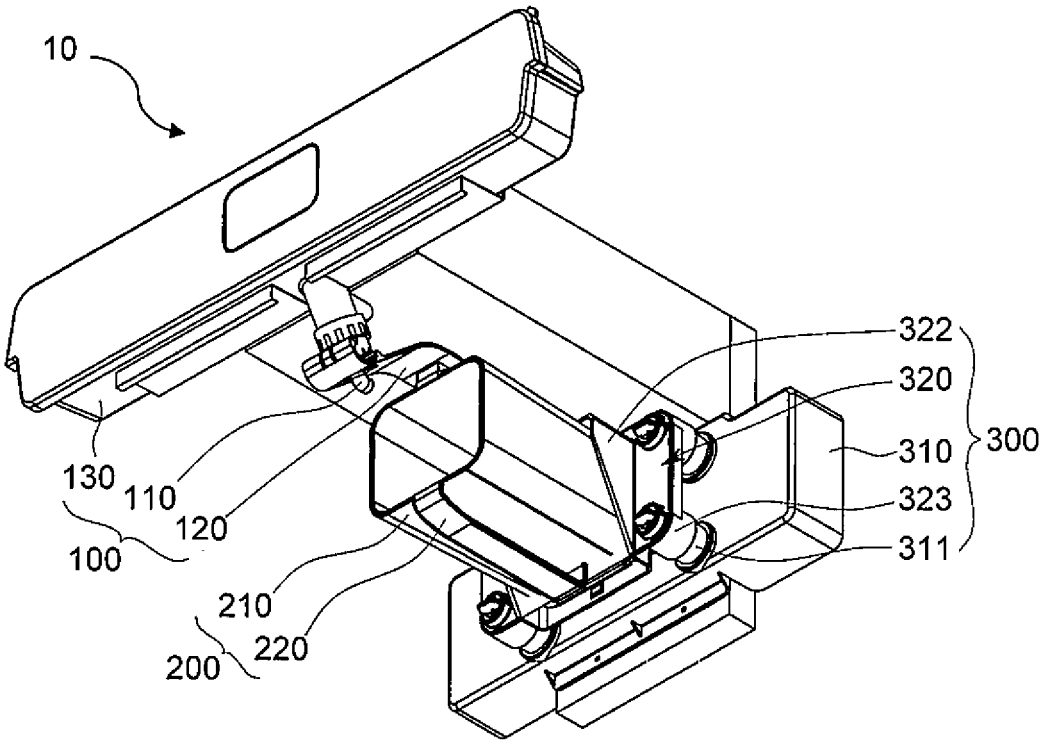
FIG. 1 is a perspective view of an exemplary dispenser for a refrigerator according to embodiments of the present disclosure.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings.

Unless particularly defined otherwise, all terms used herein have the same meanings as general meanings of terms which are understood by those skilled in the art, and if a term used herein conflicts with a general meaning of the term, the meaning of the term defined herein will supersede the general meaning.

The disclosure described below explains exemplary embodiments of the present disclosure, but does not limit the scope of the present disclosure. Like reference numerals indicate like elements throughout the specification.

Figure 2:
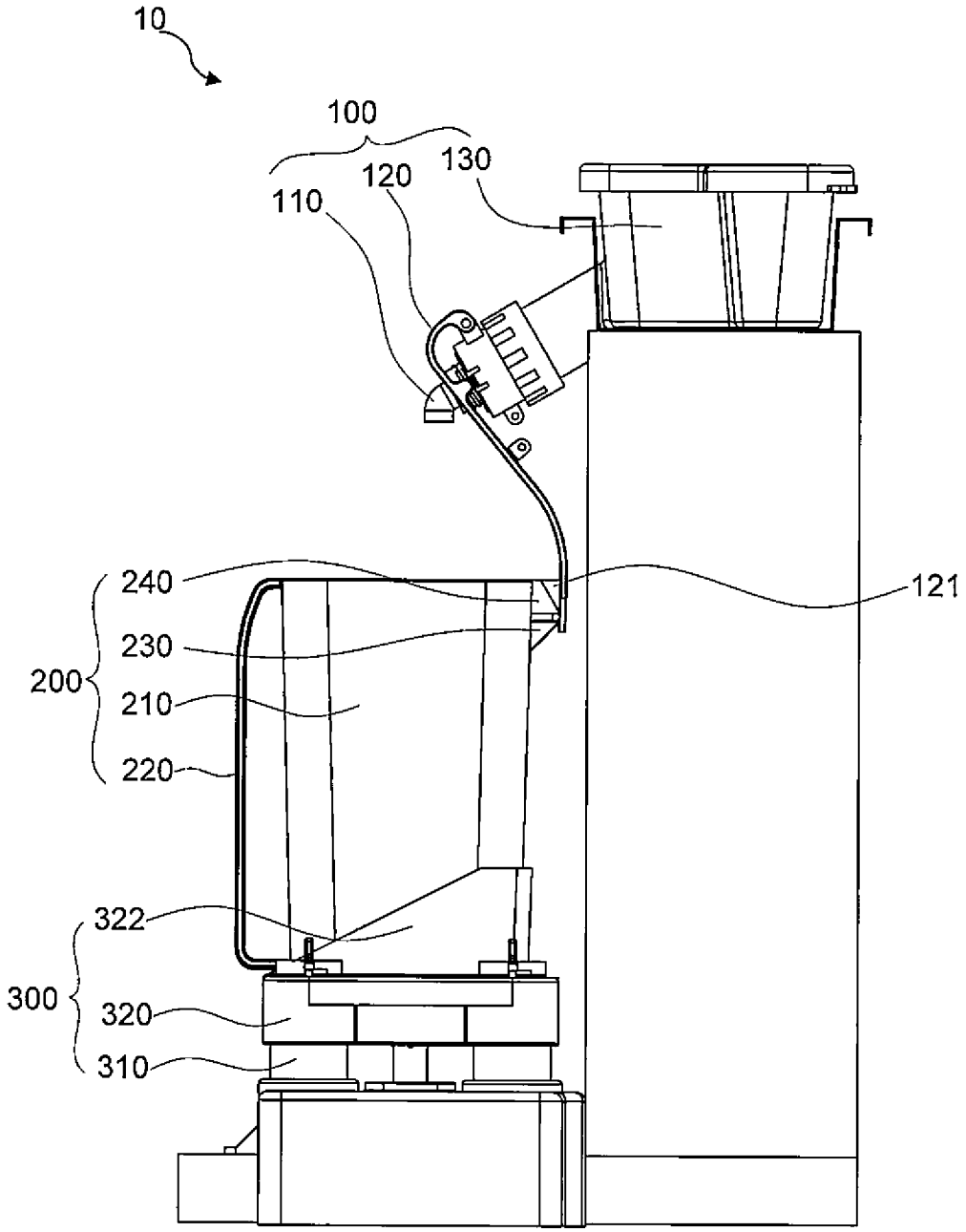
FIG. 2 is a side view of the exemplary dispenser depicted in FIG. 1 according to embodiments of the present disclosure.
Figure 3:
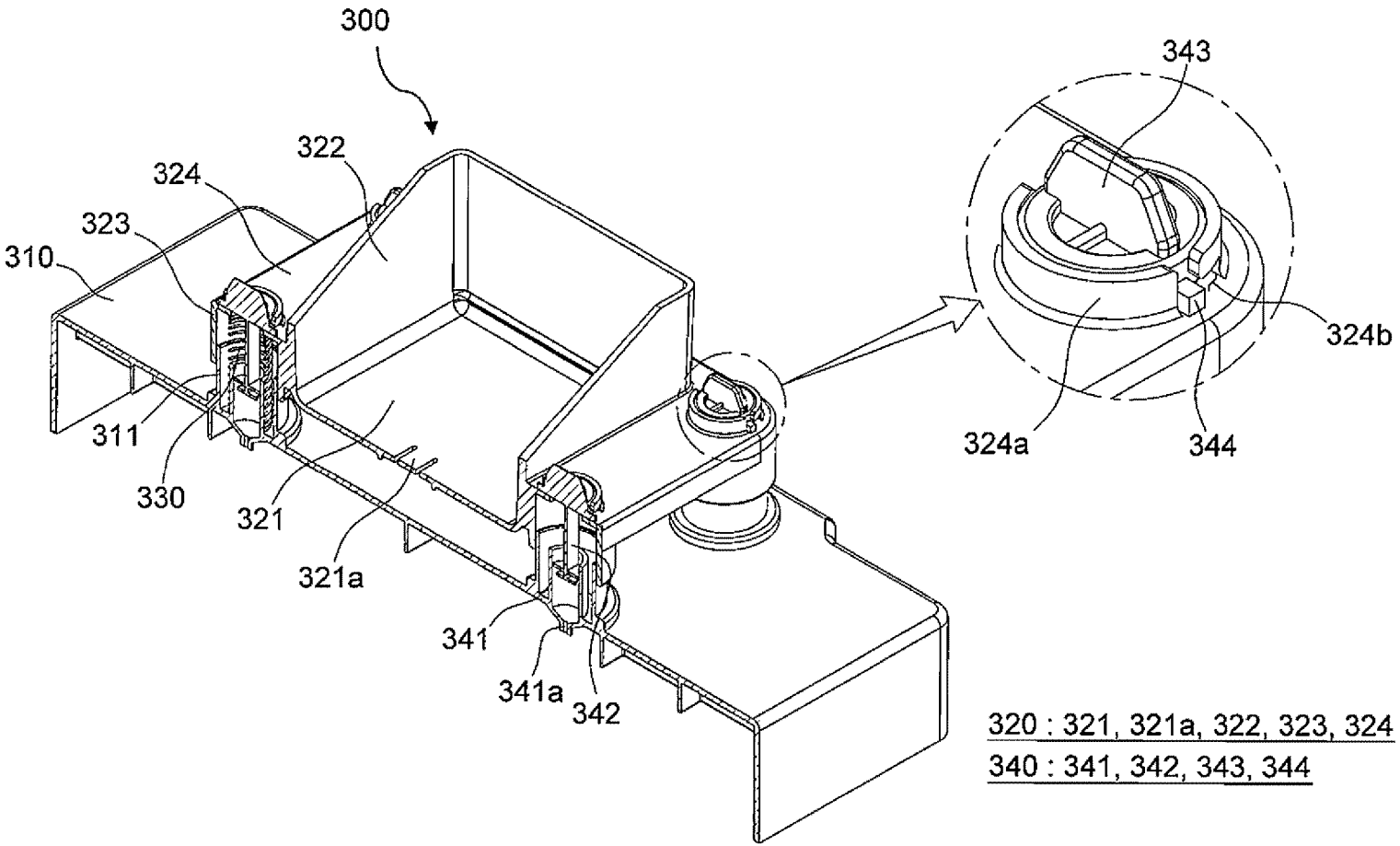
FIG. 3 is a cross-sectional view of an exemplary support portion of a dispenser for a refrigerator according to embodiments of the present disclosure.

Referring to FIGS. 1 to 3, a dispenser 10 for a refrigerator may include a liquid discharge unit 100, a liquid receiving unit 200, and a support unit 300.

Figure 4:
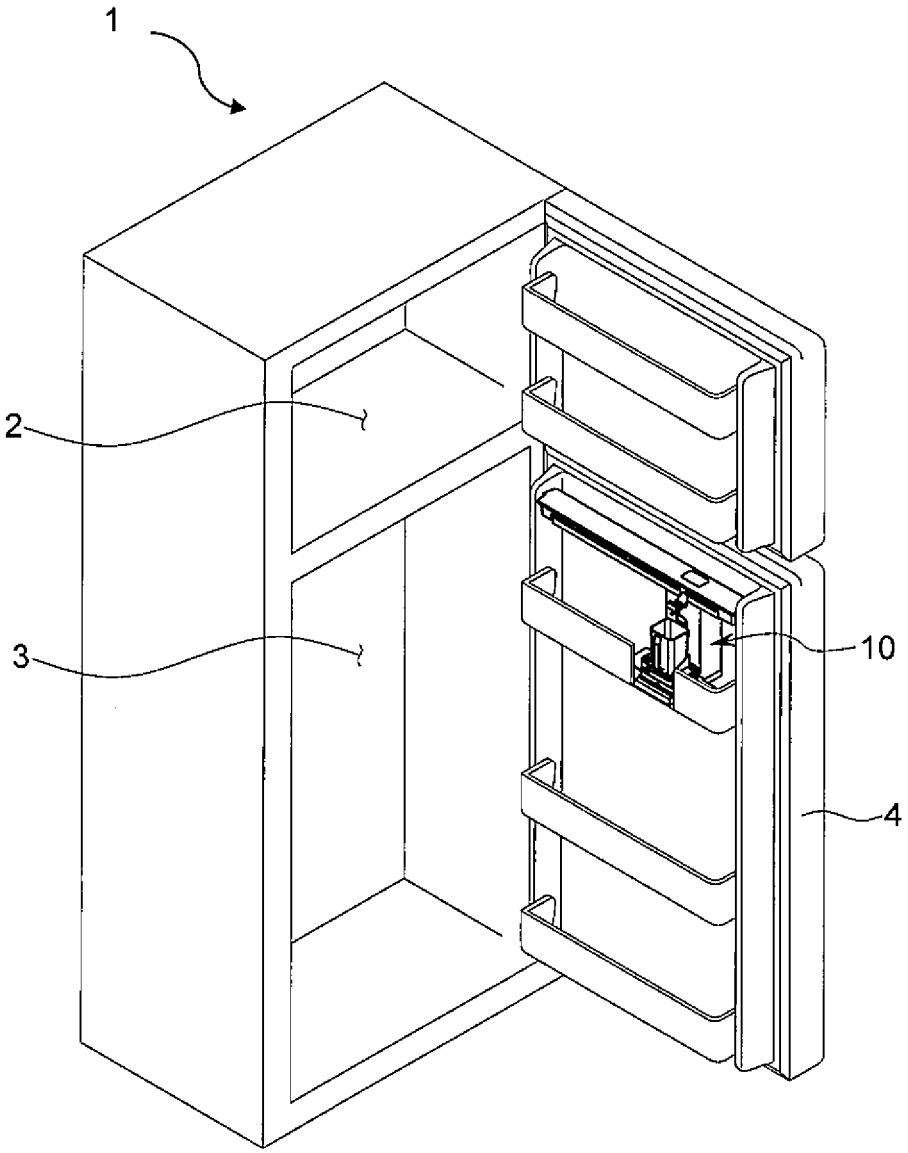
FIG. 4 is a perspective view of a refrigerator including an exemplary dispenser according to embodiments of the present disclosure.
Figure 5:
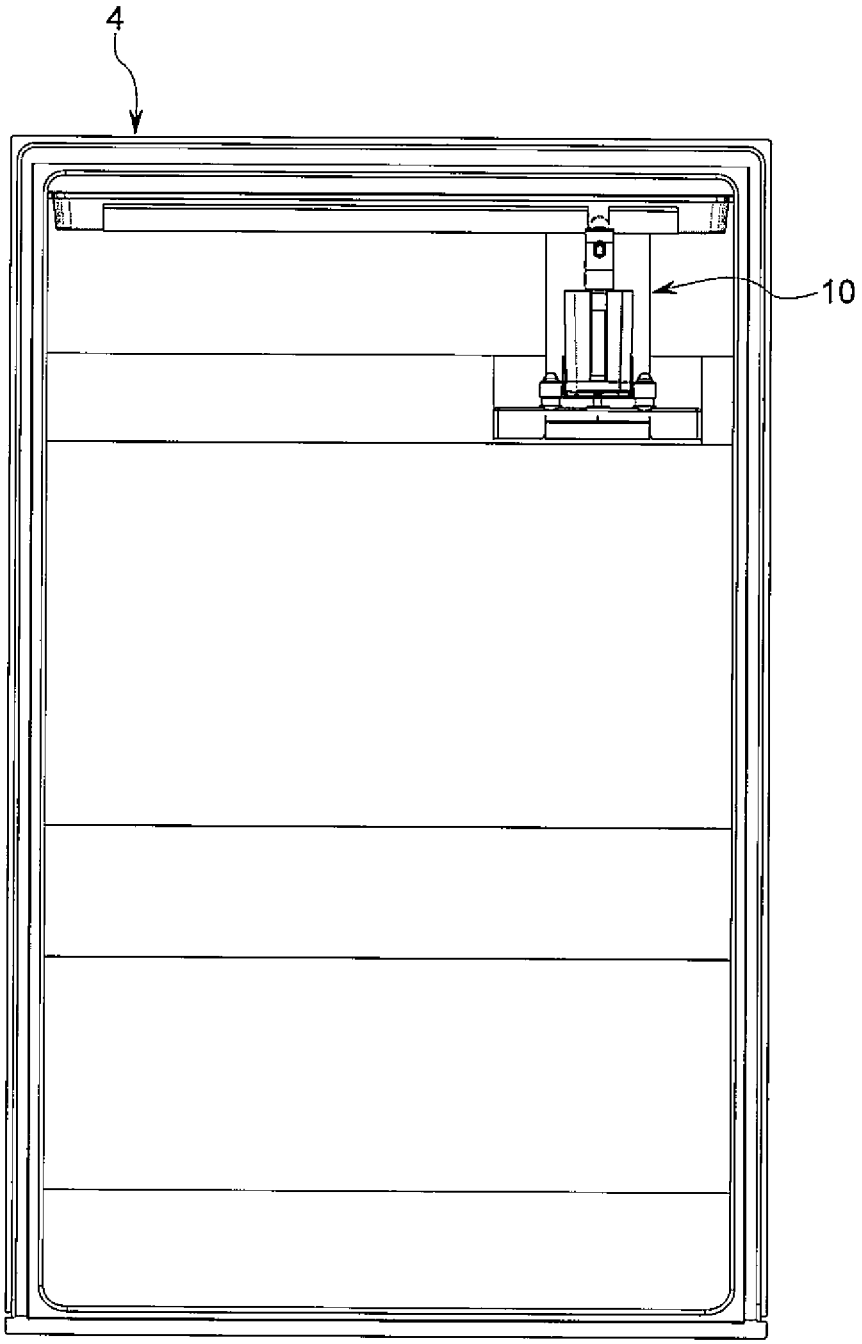
FIG. 5 is an interior view illustrating an exemplary dispenser disposed on a door of a refrigerator according to embodiments of the present disclosure.

Referring to FIGS. 4 and 5, the dispenser 10 is disposed on a door 4 of a refrigerator 1, where the door 4 may be opened and closed to selectively seal a refrigeration chamber 3. The dispenser 10 may be disposed on an interior surface of the door 4, for example, at a position where the user can easily access the liquid receiving unit 200 when the door is open.

With regard to FIG. 1, a front perspective views of a dispenser 10 for a refrigerator is depicted according to embodiments of the present disclosure. With regard to FIG. 2, a side perspective view of the dispenser 10 is depicted according to embodiments of the present disclosure. The liquid discharge unit 100 may include a nozzle 110 through which liquid received in the dispenser is discharged, and a lever 120 which opens and closes the nozzle 110 based on whether the lever 120 is pressed. According to some embodiments, the liquid discharged by the nozzle 110 is supplied from outside of the refrigerator.

A liquid supply unit 130 is separately disposed inside the refrigerator, but the present disclosure is not limited thereto, and the liquid may be supplied from outside the refrigerator, using external piping, for example.

When the liquid receiving unit 200 is seated on a support unit 300, a lever 120 may be pressed by the liquid receiving unit 200 to open the nozzle 110.

The nozzle 110 may be disposed such that the discharged liquid flows along an inner surface of the liquid receiving unit 200, which prevents or reduces noise generated when liquid is moved to the liquid receiving unit 200.

The liquid receiving unit 200 includes a body 210 which receives liquid discharged from the liquid discharge unit 100. The body may be open on one side and include a handle 220 disposed on another side of the body 210, and a discharge portion 230 through which liquid is discharged from body 210 in a specific direction.

A portion of the liquid receiving unit 200 presses the lever 120 and may include an inclined surface 240, where the width of the inclined surface 240 increases in a direction toward a bottom end of the liquid receiving unit 200. A portion of the lever 120 which is pressed by the liquid receiving unit 200 may include an inclined surface 121, where the width of the inclined surface increases in a direction toward the liquid supply unit.

A seating unit 320 is configured move downward due to the weight of liquid received in the liquid receiving unit 200. When the weight of liquid stored in the liquid receiving unit is above a certain weight (a "threshold weight"), the seating unit moves downward so that the first inclined surface of the liquid receiving unit no longer presses the second inclined surface of the lever 120. The lever 120 is thereby released. As a result, the nozzle 110 is closed and the supply of the liquid to the liquid receiving unit 200 is blocked. According to some embodiments, a piston is used to control the vertical movement of the seating unit 320.

The support unit 300 may be configured to stop applying force to lever 120 when the support unit 300 is moved downward due to the weight of the liquid received in the liquid receiving unit 200.

With regard to FIG. 3, a cross-sectional view of an exemplary support portion of a dispenser for a refrigerator is depicted according to embodiments of the present disclosure. The support unit 300 may include a base 310, the seating unit 320, an elastic unit 330, and a damper 340.

The base 310 is fixed to a surface of the refrigerator door, and may include support members 311 accommodated by support grooves 323.

The seating unit 320 is disposed on the base 310 and can be moved vertically, and the liquid receiving unit 200 may be seated on the seating unit 320. Specifically, the seating unit 320 may include a bottom portion 321, and a lateral portion 322 that extends upward from the bottom portion 321. The seating unit 320 may be open on one side so that the liquid receiving unit 200 can slide out of the support unit 300 to remove the liquid receiving unit from the refrigerator. The liquid receiving unit 200 can slide into the open portion of the seating unit 320 to insert the liquid receiving unit 200 into the seating unit 320. The seating unit 320 may further include a flange 324 on the lateral portion 322, and may include at least one support groove 323 having an opening facing the base 310.

The liquid receiving unit 200 may be guided through an open portion of the seating unit 320. In addition, a groove (not illustrated) may be disposed on a bottom portion of the liquid receiving unit 200, and a protrusion portion 321*a*, which may be inserted into the accommodating groove, is disposed on the bottom portion of the seating unit 320. As a result, the liquid receiving unit 200 may be inserted and securely fixed to the seating unit 320.

Flange 324 accommodates the support protrusion 311 of the base 310, and may support the seating unit 320 so that the seating unit 320 can move vertically up and down. The elastic unit 330 may be disposed in a hollow portion of the support protrusion 311.

Specifically, the elastic unit 330 may be disposed between the base 310 and the seating unit 320, and may provide a force that allows the seating unit 320 to return to an upward position. The elastic unit 330 may comprise a coil spring attached to the support protrusion 311, for example.

Four flanges 324, four support members 311, and four elastic units 330 may be disposed on sides of the receiving unit 200 in order to support and stabilize the liquid receiving unit 200; however, the present disclosure is not limited thereto.

The damper 340 may be disposed between the base 310 and the seating unit 320 of the support unit 300. Specifically, the damper 340 may include a cylinder 341 disposed inside the support protrusion 311, and a piston 342 disposed in the support groove 323 of the seating unit 320 that moves vertically within the cylinder 341. A hole 341*a* having a diameter smaller than an inner diameter of the cylinder 341 may be formed on an end of the cylinder 341.

Although not illustrated, the damper 340 may further include a sealing portion including an elastic material that creates a seal between the piston 342 and an inner surface of the cylinder 341. The sealing portion may include a round sealing member (e.g., an O-Ring) disposed on the piston.

The seating unit 320 may be slowly moved downward by the damper, even when liquid flows rapidly into the liquid receiving unit 200, and the seating unit 320 may be slowly moved upward, even when the liquid receiving unit 200 is removed from the seating unit 320. In other words, the damper may prevent the seating unit from moving too quickly when liquid is added, or when the liquid receiving unit is removed, thereby avoiding damage to the seating unit. As a result, it is possible to add liquid to the receiving unit while maintaining stability and producing a relatively small amount of noise.

In order to secure the piston 342 within the support groove 323, a fastening piece 343, including a fastening protrusion 344 that protrudes laterally, may be disposed at an upper side of the piston 342. A rim portion 324*a* for accommodating the fastening piece 343 may be disposed at an upper side of the flange 324 corresponding to the support groove 323, and a fastening groove 324*b* having an L shape may be disposed on one side of the rim portion 324*a*.

When the piston 342 is inserted downward into a hole of the rim portion 324*a*, and the fastening piece 343 is rotated clockwise or counterclockwise to seat the fastening piece 343 within the rim portion 324*a*, the fastening protrusion 344 is fixed to the fastening groove 324*b*. As a result, the piston 342 is secured within the support groove 323.

With regard to FIG. 4, a perspective view of an exemplary refrigerator 1 including an exemplary dispenser 10 is depicted according to embodiments of the present disclosure. The dispenser 10 may be disposed on an interior surface the door 4 of the refrigerator 1. The door 4 may be selectively opened and closed to provide access to a refrigeration compartment 3 and/or a freezer compartment 2.

With regard to FIG. 5, a view of an interior surface of the exemplary refrigerator door 4 including the dispenser 10 is depicted according to embodiments of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A liquid dispenser for a refrigerator, the liquid dispenser comprising:

a liquid discharge unit comprising a nozzle for discharging liquid, and a lever configured to selectively open and close the nozzle, wherein the nozzle is open when the lever is pressed;

a liquid receiving unit that receives liquid discharged from the liquid discharge unit; and a support unit, wherein the liquid receiving unit is disposed on a top surface of the support unit, wherein the liquid receiving unit is configured to press the lever when a weight of liquid stored in the liquid receiving unit is below a threshold, and wherein the liquid receiving unit is further configured to release said lever when the liquid receiving unit is moved away from said lever due to the weight of liquid stored in the liquid receiving unit being above said threshold.

2. The liquid dispenser of claim 1, wherein the liquid dispenser is disposed inside a door of the refrigerator.

3. The liquid dispenser of claim 1, wherein the nozzle is configured to discharge liquid, wherein the liquid flows along an inner surface of the liquid receiving unit.

4. The liquid dispenser of claim 1, wherein the liquid receiving unit comprises a first inclined surface, and wherein the lever comprises a second inclined surface that contacts the first inclined surface when a weight of liquid stored in the liquid receiving unit is below said threshold that causes the lever to be pressed.

5. The liquid dispenser of claim 1, wherein the support unit comprises:

a base disposed on a surface of a door of the refrigerator;

a seating unit disposed between the liquid receiving unit and the base, wherein the seating unit is configured to move up and down vertically; and an elastic unit disposed between the base and the seating unit that causes the liquid receiving unit to return to an upward position.

6. The liquid dispenser of claim 5, wherein the support unit further comprises a damper disposed between the base and the seating unit, wherein said damper is configured to that reduce noise generated by the liquid dispenser.

7. The liquid dispenser of claim 5, wherein the seating unit comprises a bottom portion comprising a groove, and a lateral portion that extends upward from the bottom portion, and wherein the liquid receiving unit comprises a member disposed on a bottom surface of the liquid receiving unit and is configured to be inserted into the groove.

8. The liquid dispenser of claim 7, wherein the seating unit further comprises a flange disposed on the lateral portion of the seating unit and at least one support groove, wherein the base further comprises a hollow support member that is accommodated by the support groove, and wherein the elastic unit comprises a spring disposed in the hollow support member.

9. The liquid dispenser of claim 6, wherein the seating unit further comprises a flange disposed on a lateral portion of the seating unit and at least one support groove, wherein the base further comprises a hollow support member accommodated by the at least one support groove, wherein the damper comprises a cylinder and a piston disposed inside the at least one support groove, and wherein further the piston is configured to move vertically within the cylinder.

10. The liquid dispenser of claim 9, wherein a first end of the cylinder comprises a hole, and wherein a diameter of the hole is smaller than an inner diameter of the cylinder.

11. A refrigerator comprising:

a refrigeration compartment;

a freezer compartment; and a door configured to selectively open and close the refrigeration compartment and the freezer compartment, wherein said door comprises:

a liquid discharge unit comprising a nozzle for discharging liquid;

a lever configured to selectively open and close the nozzle, wherein the nozzle is open when the lever is pressed; and a liquid receiving unit that receives liquid discharged from the liquid discharge unit, wherein the liquid receiving unit is configured to press the lever when a weight of liquid stored in the liquid receiving unit is below a threshold, and is configured to release said lever when the weight of liquid stored in the liquid receiving is above said threshold.

12. The refrigerator of claim 11, wherein the nozzle is configured to discharge liquid that flows along an inner surface of the liquid receiving unit.

13. The refrigerator of claim 11, wherein the liquid receiving unit comprises a first inclined surface, and wherein the lever comprises a second inclined surface that contacts the first inclined surface when a weight of liquid stored in the liquid receiving unit is below said threshold, which causes the lever to be pressed.

14. The refrigerator of claim 11, wherein said door further comprises a support unit comprising:

a base disposed on a surface of the door of the refrigerator;

a seating unit disposed between the liquid receiving unit and the base, wherein the seating unit is configured to move vertically up and down; and an elastic unit disposed between the base and the seating unit that causes the liquid receiving unit to return to an upward position.

15. The refrigerator of claim 14, wherein the support unit further comprises a damper disposed between the base and the seating unit and configured to reduce noise generated by liquid moving from the liquid discharge unit to the liquid receiving unit.

16. The refrigerator of claim 14, wherein the seating unit comprises a groove disposed on a bottom surface of the seating unit, and a lateral portion that extends upward from the bottom surface, and wherein the liquid receiving unit comprises a member disposed on a bottom surface of the liquid receiving unit and configured to be inserted into the groove of the seating unit.

17. The refrigerator of claim 16, wherein the seating unit further comprises a flange disposed on a lateral portion of the seating unit, and at least one support groove, wherein the base further comprises a hollow support member accommodated by the support groove, and wherein the elastic unit comprises a spring disposed in the hollow support member.

18. The refrigerator of claim 15, wherein the seating unit further comprises a flange disposed on a lateral portion of the seating unit and at least one support groove, wherein the base further comprises a hollow support member accommodated by the at least one support groove, wherein the damper comprises a cylinder and a piston disposed inside the at least one support groove, and wherein the piston is configured to move vertically within the cylinder.

19. The refrigerator of claim 18, wherein a first end of the cylinder comprises a hole, and wherein a diameter of the hole is smaller than an inner diameter of the cylinder.

* * * * *